United States Patent [19]

Tanner, Jr. et al.

[11] Patent Number: 4,475,368

[45] Date of Patent: Oct. 9, 1984

[54] METHOD AND APPARATUS FOR RESTRAIGHTENING CONTAINER SUPPORT SKIRTS

[75] Inventors: Walter K. Tanner, Jr., Chesnee; Frank A. Brinkmann, Spartanburg, both of S.C.; Terry W. Smith, N. Miami Beach, Fla.

[73] Assignee: Draft Systems, Inc., Spartanburg, S.C.

[21] Appl. No.: 496,501

[22] Filed: May 25, 1983

[51] Int. Cl.[3] ..... B21D 1/08

[52] U.S. Cl. ..... 72/10; 72/393; 72/420; 209/598; 209/600

[58] Field of Search ..... 72/10, 12, 27, 355, 72/361, 392, 393, 420, 421; 209/597, 598, 600

[56] References Cited

U.S. PATENT DOCUMENTS

| | | | |
|---|---|---|---|
| 1,058,669 | 4/1913 | Goddard . | |
| 1,400,297 | 12/1921 | Brant et al. . | |
| 1,567,387 | 12/1925 | Rode . | |
| 1,610,982 | 12/1926 | Theberath . | |
| 1,739,152 | 12/1929 | Larsen . | |
| 2,158,312 | 5/1939 | Terrell . | |
| 2,352,095 | 6/1944 | Grotnes | 72/393 |
| 2,696,296 | 12/1954 | Simpson et al. | 209/598 |
| 2,774,406 | 12/1956 | McCoy | 72/393 |
| 3,008,508 | 11/1961 | Fabbro et al. . | |
| 3,241,348 | 3/1966 | Roper . | |
| 3,262,304 | 7/1966 | Schultz | 72/393 |
| 3,289,287 | 12/1966 | Guritz . | |
| 3,566,640 | 3/1971 | Harrington | 72/10 |
| 4,304,034 | 12/1981 | Trevarrow | 29/159 R |

*Primary Examiner*—Lowell A. Larson

*Attorney, Agent, or Firm*—Luke J. Wilburn, Jr.; Wellington M. Manning, Jr.

[57] ABSTRACT

Method and apparatus for restraightening depending bent metal end skirts of cylindrical containers, such as beer kegs, wherein the containers moving in a path of travel for processing are automatically interrogated by sensing heads which engage the rims of the normally circular end skirts of the containers to detect the presence or absence of a bent portion thereof. Containers having detected bent skirt portions are directed from the main processing path to a skirt straightening station where the ends of the container are supported in retaining rings of upper and lower straightening heads while arcuately spaced pry levers, or paws, located centrally in each retaining ring move radially outward from a central nested position to engage inwardly bent skirt portions of the container to lift and push the same outwardly into a circular configuration. The container is rotated in the rings between engagements by the paws to bring all portions of the skirts into position for straightening. Straightened containers are moved to a holding station where they are reinserted into the main path of travel as a subsequent detected bent container is moved from the main path into the straightening station.

20 Claims, 11 Drawing Figures

METHOD AND APPARATUS FOR RESTRAIGHTENING CONTAINER SUPPORT SKIRTS

This invention relates to method and apparatus for restraightening the depending protective end skirts of metal containers and, more particularly, to method and apparatus for detecting and straightening bent skirt portions of refillable metal containers, such as beer kegs and the like, as the kegs are processed for washing and/or refilling of the same.

BACKGROUND OF THE INVENTION

It is a practice in the brewing industry to transport and sell beer in large metal kegs or containers from which the beer is dispensed by means of a tap, or other flow regulating device, attached to a central opening in one end of the keg. Beer kegs or barrels generally come in several sizes, a predominant size being a half keg of 15½ gallons which when filled weighs approximately 170 pounds. In use, beer kegs are placed in a cooled environment, "tapped" with a valved dispenser, and the contents generally maintained under pressure to facilitate dispensing the beer. Empty beer kegs are returned to the brewery for washing, sterilization, and refilling for subsequent distribution of beer to customers.

Most metal beer kegs are generally cylindrical in shape and have outwardly curved end walls protected by depending circular metal skirts having reinforcing chimes, or rims. The skirts extend generally from about 3 to 5 inches beyond the curved end walls of the keg to protect the end walls and the beer-dispensing opening, and to reinforce and strengthen the overall keg construction. Oppositely disposed hand holes may be provided in the keg skirt at the upper end of the keg to facilitate handling. Certain other keg constructions having a metallic main body are provided with molded plastic polyurethane end skirts to protect the ends of the keg during handling and use.

Because of the relatively heavy weight of filled beer kegs, the kegs are often subject to rough handling in loading and unloading operations. On occasion, the kegs may be dropped onto a hard support surface, such as a concrete floor causing portions of the depending metal end skirts of the keg to be bent inwardly when the skirt rim strikes the hard surface. Bent metal skirts create a safety hazard in handling and may not provide stable support when a keg is placed end up on a flat surface for storage or dispensing of beer. In addition, during keg cleaning and refilling operations, it is a practice to convey the kegs end up on a moving conveyor as the interior of the kegs are washed, sterilized, and refilled with beer. These operations are accomplished by the insertion of probes into the end openings of the kegs as they are supported on the conveyor. It is thus desirable that bent metal skirt portions of the beer kegs be straight so that the rims of the skirts lie in a common plane and in circular disposition to ensure proper alignment of the keg openings with the cleaning and filling probes.

It has been a practice to straighten bent metal end skirt portions of beer kegs. Heretofore, keg skirt straightening devices have been semi-automatic in operation, requiring manual insertion of each end skirt of a keg into the straightening device for performance of the restraightening operation. In some instances, bent metal skirts of kegs have been straightened by means of a two member expander mechanism which is inserted into the opening of a skirt of the keg. One of the expander members is engaged with an interior wall portion of the skirt and the other moves to engage an opposite interior wall portion of the skirt to push bends in the skirt outwardly into a circular configuration. It is also understood that there are also keg skirt straightening devices which rotate the keg between rollers which press against opposite sides of the skirt to straighten the same.

More recently, certain of the semi-automatic straightening devices have included a circular clamping ring into which an end of the keg with its skirt portion is inserted, and a central expander mechanism consisting of three arcuately spaced elements which move radially outward to engage and straighten inwardly bent portions of the skirt at spaced locations about the skirt.

BRIEF OBJECTS OF THE PRESENT INVENTION

It is an object of the present invention to provide improved apparatus for straightening bent metal skirt portions of metal containers which permits rapid handling of the containers during straightening operations.

It is another object to provide an improved automated skirt straightener for metal containers wherein moving containers on a conveyor line may be interrogated during their travel to detect the presence of bent skirt portions, with containers having detected bent skirt portions being moved to a skirt straightening station for straightening, and returned to the conveyor line for subsequent operations.

It is a further object to provide an automated skirt straightening apparatus having means for interrogation, and for simultaneous straightening of both end skirts of containers during the skirt straightening operation.

It is an object to provide an improved method of straightening the depending end skirts of metal containers in a more efficient and rapid manner.

It is a more specific object to provide an improved method for automatically interrogating a plurality of metal containers having depending metal end skirts to determine the presence or absence of bent portions of the skirts, and for automatically straightening those skirts having bent skirt portions which are detected.

BRIEF DESCRIPTION OF THE INVENTION

The present invention concerns method and apparatus for straightening bent metal skirt portions of generally cylindrical containers. In a preferred embodiment, the apparatus includes means for automatically interrogating the depending metal end skirts of containers moving in a primary path of travel to detect the presence or absence of a bend therein, and means for diverting those containers having detected bent end skirt portions to a skirt straightening station. Opposed straightening heads at the station move to retain the two end skirts of the containers and a plurality of straightening members centrally arcuately disposed within each circular skirt opening move radially outward to engage inwardly bent portions of the skirts and move them outward into a straightened, circular configuration. During the straightening cycle, the container is rotated periodically about its central cylindrical axis to bring all portions of the skirts into position for engagement with the straightening members. After straightening, the container is moved to a holding station where it is redirected into the primary path of travel for subsequent processing. Containers or kegs having plastic end skirts are not interrogated or subjected to a straightening operation, but are passed for further cleaning and filling operations.

DETAILED DESCRIPTION OF PREFERRED EMBODIMENTS

Figure 1:
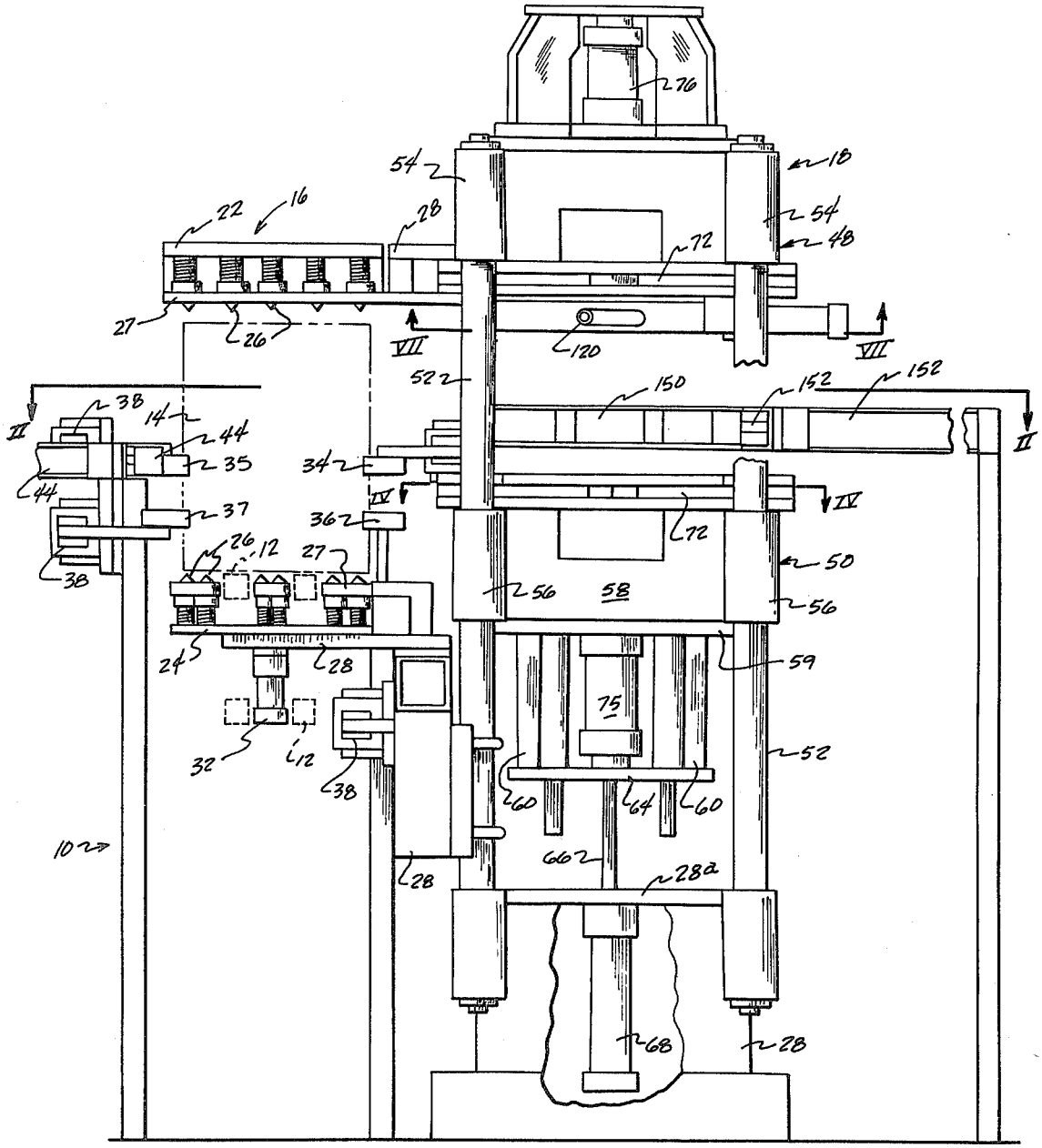
FIG. 1 is an end elevation view, with portions broken away, of apparatus for automatically interrogating a plurality of moving metal containers to determine the presence of bent metal skirt portions thereon, for moving containers having detected bent skirts out of the path to automatically straighten the containers, and for reinserting the straightened containers back into their initial path of travel for further processing.
Figure 2:
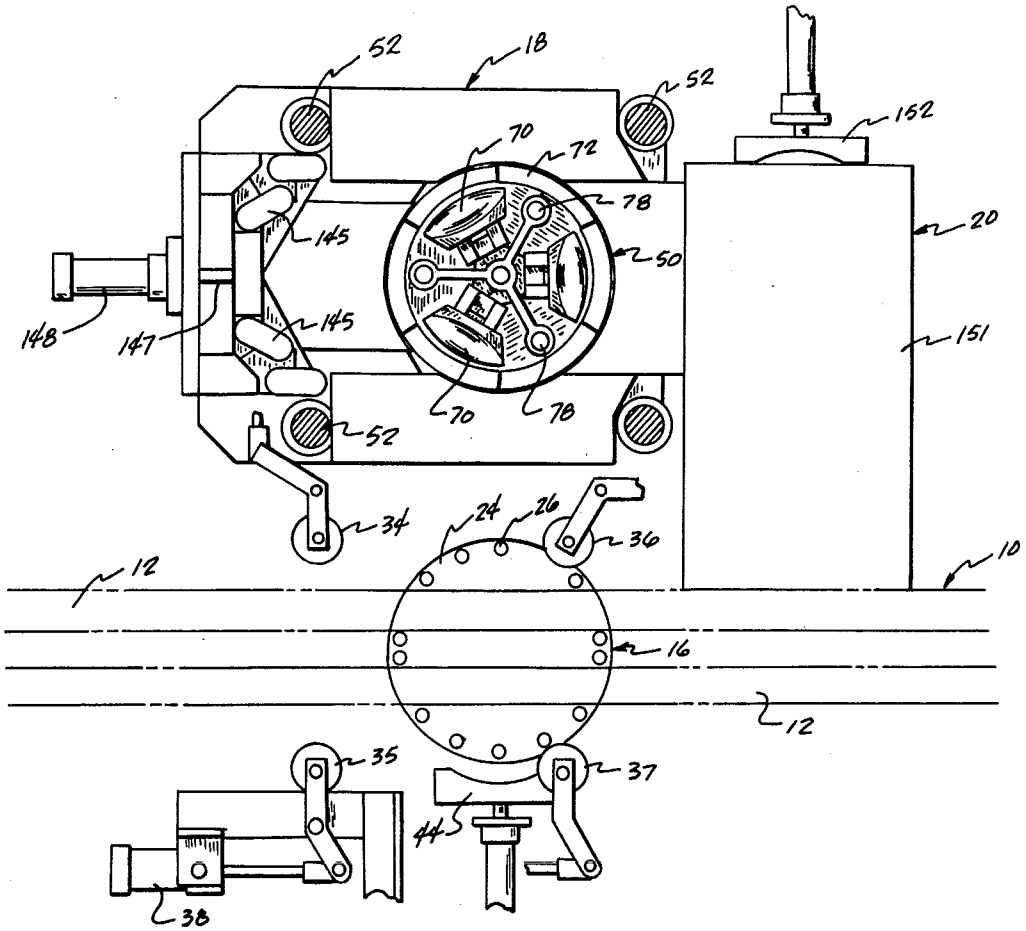
FIG. 2 is a horizontal plan view of major portions of the apparatus of FIG. 1 taken generally along line II—II thereof and looking in the direction of the arrows.

The foregoing as well as other objects of the present invention may be best understood from the following detailed description of preferred embodiments of the invention when taken in connection with the accompanying drawings. Referring more specifically to FIGS. 1 and 2, the container skirt straightening apparatus of the present invention is shown in conjunction with a portion of a main conveyor 10 typically employed in a brewery to transport empty beer kegs for washing and filling operations. The conveyor includes a pair of spaced endless chains 12 driven by conventional drive means, not shown, on which a plurality of beer kegs, one of which 14 is shown in phantom in FIG. 1, are supported on end for movement in a desired path of travel for washing, sterilizing, and filling with beer.

The apparatus of the present invention generally includes a keg interrogator station 16 located directly in the main conveyor path, a keg skirt straightening station 18 located at a right angle to and immediately adjacent the interrogator station, and a keg holding station 20 (FIG. 2) located at a right angle to the straightening station and adjacent a downstream portion of the main conveyor to receive straightened kegs from straightener station 18 and permit return of the same in orderly fashion onto the main conveyor 10 for subsequent processing.

The Interrogator Station

As best seen in FIGS. 1 and 2, interrogator station 16 is located in straddling relation of the main conveyor chains 12 and comprises vertically spaced upper and lower horizontally disposed sensing heads 22, 24. Each head includes a circular array of spaced plungers 26 which are mounted for vertical movement with their ends protruding through openings of horizontal plates 27. Each of the plungers is spring-biased for vertical displacement upon contact of their protruding ends with unbent, or straight, metal rim portions of corresponding upper and lower skirts of a metal keg to be interrogated. The upper sensing head 22 is attached in fixed position to a portion of the main support frame 28 of the skirt straightening apparatus. The lower sensing head 24 is attached to a portion of the support frame 28 for vertical movement to lift a keg to be interrogated upwardly above the conveyor chains 12 so that its upper and lower skirt rims are engaged by the sensing plungers 26 of both heads during the rim-sensing operation. Suitable power means, such as a double-acting fluid-actuated piston 32, is employed to raise and lower the lower sensing head 24. FIG. 1 shows the lower sensing head 24 in the down position, while FIG. 3 shows the head 24 raised to bring both upper and lower head plungers into engagement with the keg skirt rims.

As seen in FIGS. 1 and 2, keg stop rollers 34–37 are located at each of the four corners of the interrogator station 16. One pair of the rollers 34, 35 at the entrance of the interrogator station restrains the line of kegs on the main conveyor 10 from coming into the station during interrogation, and the other pair 36, 37, hold a single keg in the station during interrogation. Each of the stop rollers 34–37 is mounted on a support arm for pivotal movement into and out of the conveyor path to engage and release kegs in accordance with signal information which operates valves of double-acting fluid operated pistons 38 attached to each roller.

Figure 3:
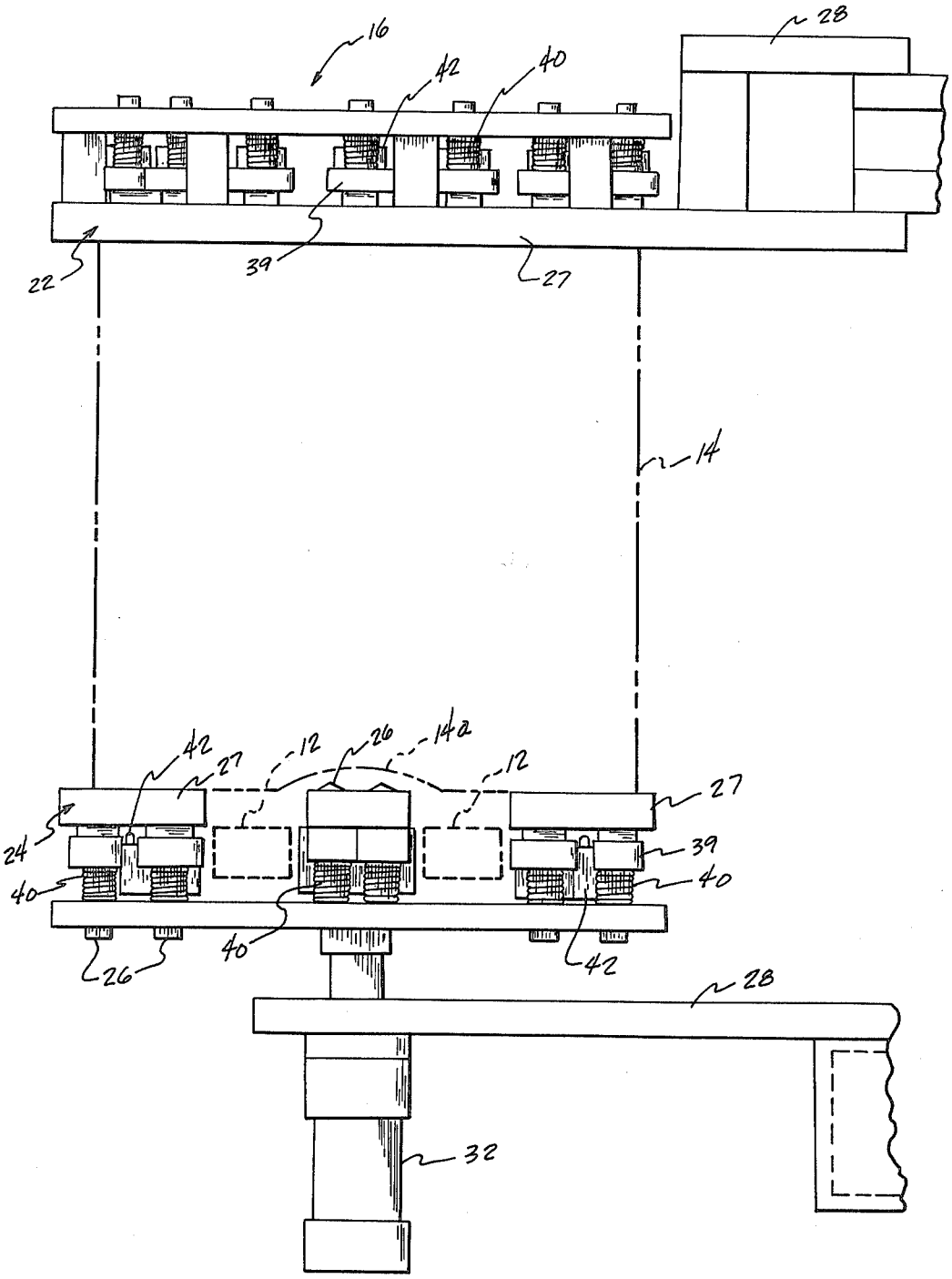
FIG. 3 is an enlarged broken away end elevation view of a portion of the interrogator section of the apparatus of FIG. 1.

As best seen in FIG. 3, which shows the lower sensing head 24 in raised position to bring the skirt rims of the keg 14 into engagement with plungers 26, each of the plungers of the upper and lower heads 22, 24 has a radial flange 39 which is biased by a surrounding spring 40. The flange of each plunger also carries a proximity switch, certain of which 42 are seen, which is activated when the plunger is displaced by contact with an unbent rim portion of the skirt of the keg. All switches 42 of each head are connected in series. If either the upper or the lower skirt of the keg has a bent skirt portion, as seen at 14*a*, a plunger 26 adjacent the same is not displaced upon raising of the lower head. Its proximity switch in the sensing head will not be activated, signaling a discharge pusher mechanism 44 (FIGS. 1 and 2) powered by a double-acting, fluid-actuated piston to push the interrogated keg into the skirt straightener station 18. Correspondingly, if all of the plungers of both the upper and lower heads are displaced, indicating the absence of any bent skirt portions of the skirts, the resulting electrical signal from the proximity switch circuitry will move the downstream keg stop rollers 36–37 out of the conveyor path allowing the keg to continue on the main conveyor for further processing without being subjected to a straightening operation.

The Skirt Straightener Station

Figure 8:
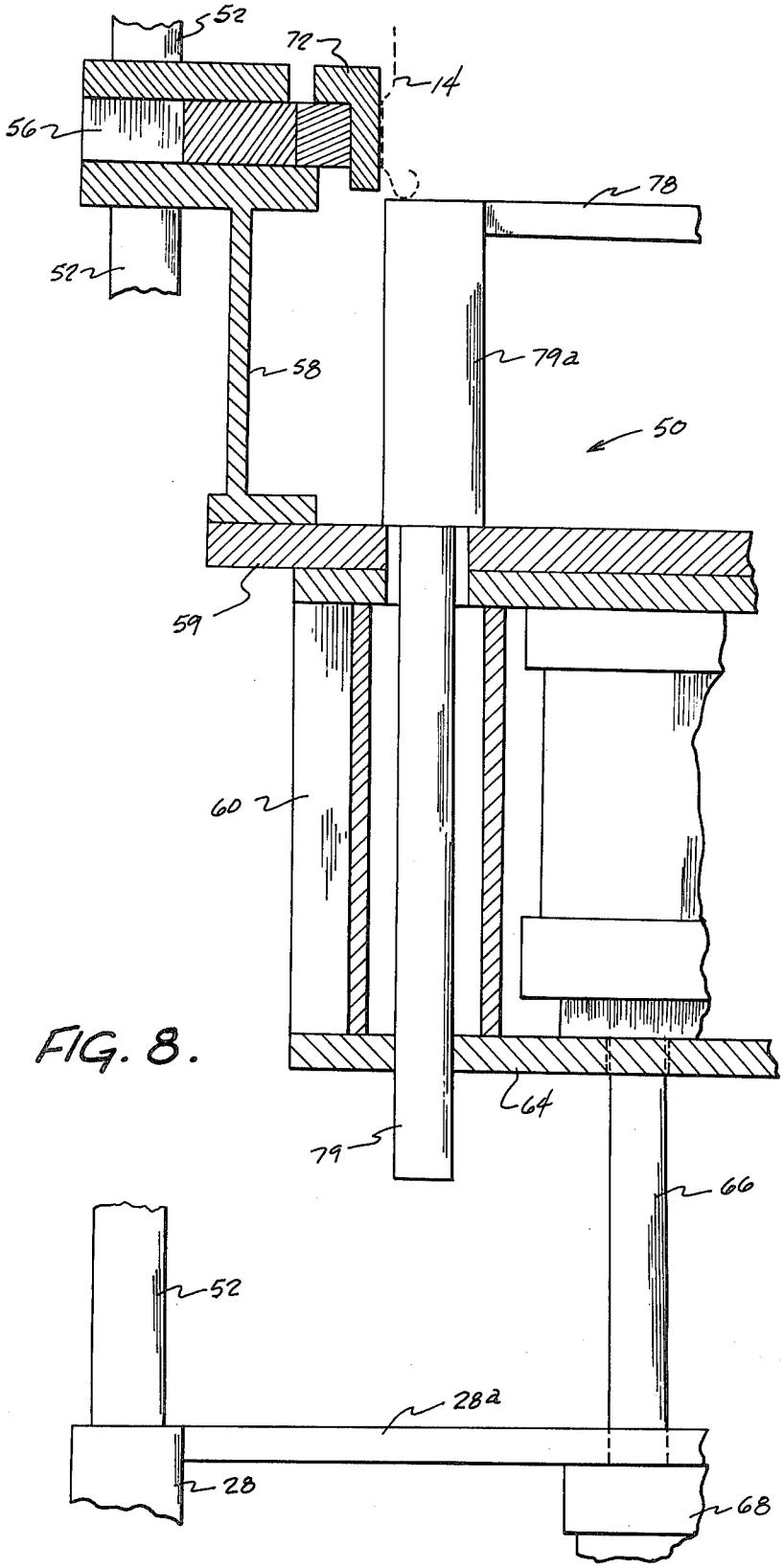
FIG. 8 is an enlarged broken away vertical section view of the lower left side of the skirt straightening station as seen in FIG. 1.

As seen in FIGS. 1 and 8, the keg skirt straightener station 18 of the straightening apparatus is mounted on main support frame 28 and includes upper and lower skirt straightening heads 48, 50 which are located in vertically spaced relation on four upright posts 52 of the frame. Upper straightening head 48 is fixed to the upper end of the posts by corner sleeves 54. Lower head 50 is mounted on sleeves 56 for vertical upward and downward movement on the posts 52.

Components of the lower straightening head 50 are supported in a generally rectangular box 58 attached at its corners to the sleeve members 56. Attached to the bottom wall 59 of the box by three arcuately spaced vertical plates, two of which 60, 62 are seen in FIG. 1, is a lower horizontal support plate 64 which is connected to the rod 66 of a double-acting hydraulic piston 68 attached to the base of support frame 28 which raises and lowers straightening head 50 on the tubular supports 52.

Located within the box 58 of the lower straightening head 50, and within the upper head 48, are three keg skirt straightening pry levers, or paws 70 (lower head paws shown in FIGS. 2 and 4), which are disposed at 120° intervals about the central vertical axis of the lower head. The paws 70 in both upper and lower heads 48, 50 are substantially identical in construction and operation, and are oppositely disposed and located centrally inside a respective horizontal retaining ring 72 of each head. The two rings are substantially identical and each consists of six arcuate sections 74 which are radially expanded, or opened, to receive respective end portions of a keg to be straightened and are contracted to closely surround the outer periphery of the keg skirts and retain the keg during the skirt straightening operation, as will be explained hereinafter.

Figure 4:
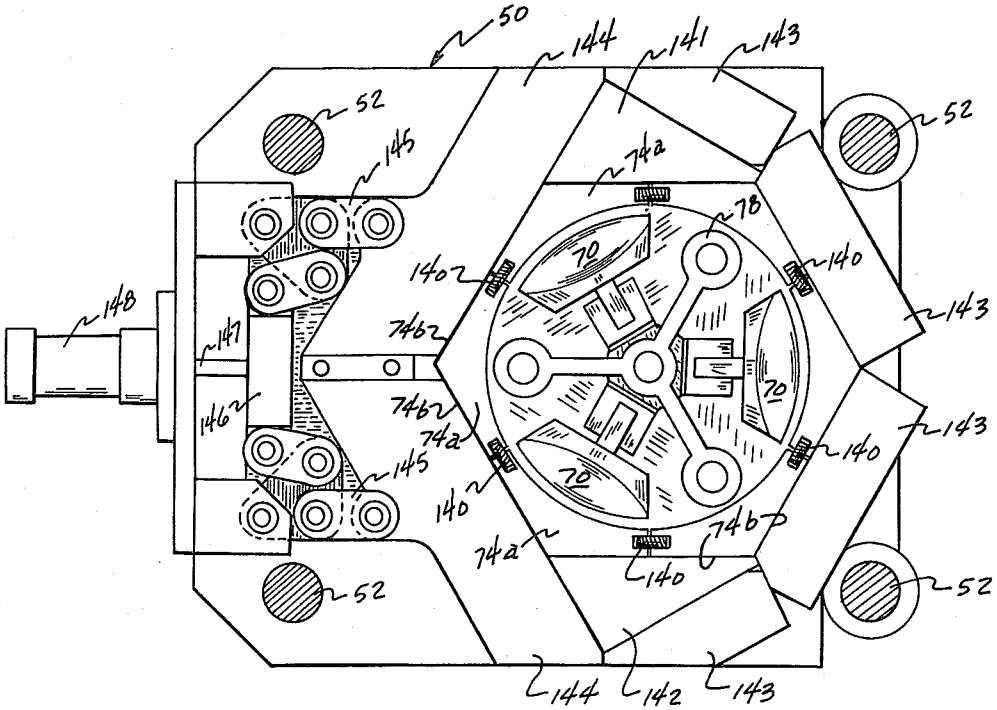
FIG. 4 is an enlarged horizontal sectional view of the lower keg retaining ring mechanism of the skirt straightening station taken generally along line IV—IV of FIG. 1 and looking in the direction of the arrows.

Each pry lever or paw 70, of both the upper and lower heads is movable from a central nested position. As seen in FIGS. 2 and 4 and as shown in broken lines in FIG. 6, the paws move radially outward toward adjacent retaining ring 72 to engage inwardly bent skirt portions of a keg received in the heads and push the bent portions back into a straightened, circular configuration. Each paw is separately operated by a double-acting hydraulic piston, one of which, 76, in each head, is seen in FIG. 1. The rod of each piston is connected to its respective paw by a linkage mechanism which will be described hereinafter.

As seen in FIGS. 2 and 8, additionally located in the support box 58 of the lower head are keg support means which consists of three interconnected horizontal radially extending arms 78 which lie above the straightening paws 70 of the lower level on a level with the top of the retaining ring 72 when the lower head 50 is in lowermost position to receive the end of a keg pushed into the straightening station 18 from interrogator station 16. As best seen in FIGS. 1 and 8, both of which show the lower head 50 in its uppermost raised position, the outer end of each keg support arm 78 is supportably attached to a vertical rod 79 which extends downwardly through an opening in the support box 58 and lower horizontal plate 64 to engage a base support plate 28*a* of the frame when the lower head 50 is in lowermost position ready to receive a keg from the interrogator station 16. As seen in FIG. 8, each rod 79 has a radially enlarged portion 79*a*, the lower edge of which engages the bottom wall 59 of support box 58 when head 50 has moved upward a sufficient distance to bring straightening paws 70 into the keg skirt opening and ring 72 into surrounding relation with the lower skirt of the keg (FIG. 8). Thereafter the keg support arms 78 are lifted upwardly with the box 58 to raise the keg and locate its upper end inside retaining ring 72 of upper straightening head 48.

Figure 5:
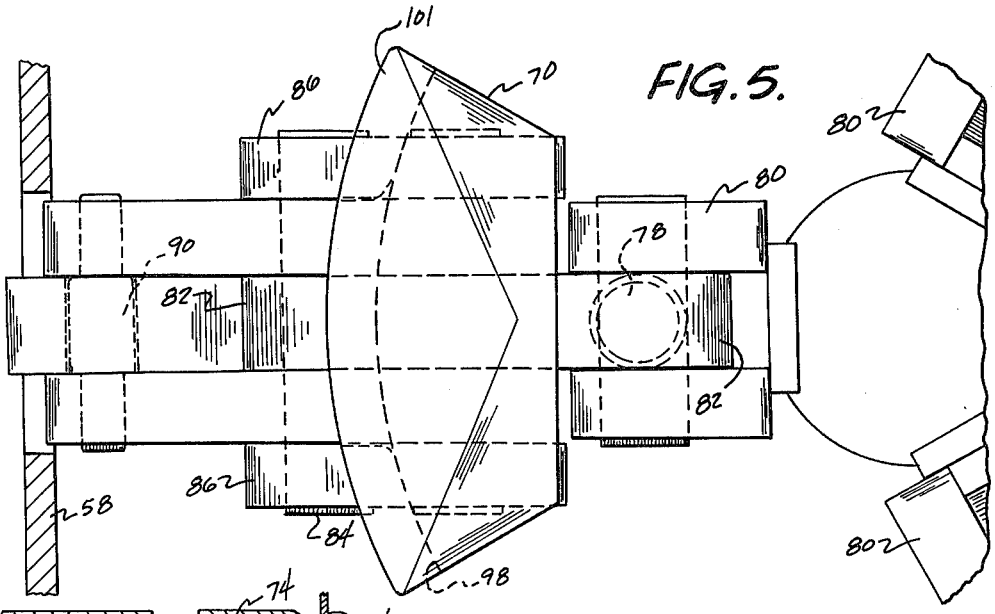
FIG. 5 is an enlarged broken away plan view of one of the keg skirt straightening members of the straightening station of the apparatus.
Figure 6:
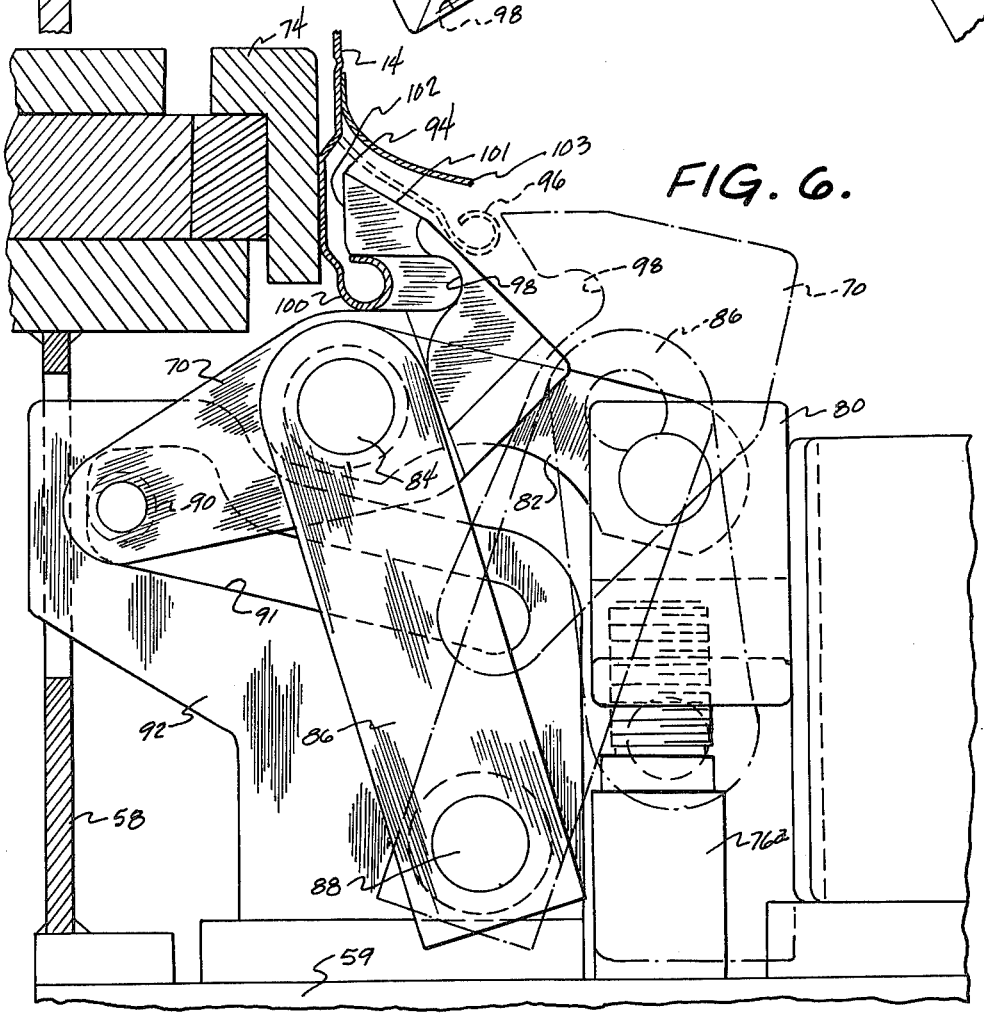
FIG. 6 is a broken away side elevation view of the straightener member shown in FIG. 5.

Since the upper and lower straightening head paws and retaining rings 72 are substantially identical in construction and operation, details of the same will thus be understood from the following description of the lower head components. FIG. 5 is an enlarged plan view and FIG. 6 is an enlarged side elevation view of one of the lower head paws 70. As seen, the hydraulic piston rod 76*a* of each paw 70 is attached by means of a clevis 80 to a toggle link 82 which is attached by a pin 84 to pivot a pair of spaced control links 86 about a pivot pin 88. The pin 84 in the control links 86 also carries the paw 70. The rotation of the paw about pin 84 is controlled by a cam follower 90 which resides in the cam slot 91 of a vertical cam plate 92.

In a retracted position, each of the three paws 70 of each head will be centrally nested adjacent the vertical central axis of the head, with lower head paws facing upwardly, as shown in FIG. 4 and with upper head paws facing downwardly. Activation of the hydraulic piston 76 of each paw 70 causes a controlled radial outward curved movement of the nose portion 94 of the paw, causing the nose portion to engage an inwardly bent portion 90 of the skirt of a keg 14 (a portion shown in broken lines in FIG. 6) and push the same radially outward of the central axis of the keg. Located just below the nose portion of the paw is an arcuate groove 98 which receives the circular rim, or chime 100, of the skirt of the keg when the paw reaches its outer limit of movement to locate the same in the desired circular contour.

As seen in FIGS. 5 and 6, the surface 101, 102 of the straightening paw 70 on either side of the nose portion 94 are arcuately curved. The upper surface 101 (FIG. 5) curves inwardly of the paw body to enable the paw to move in close proximity to the outwardly curved end wall 103 of the keg during its outward movement to pick up and pry out bent skirt portions lying in close proximity to the curved end wall of the keg. The other surface 102 of the paw is outwardly curved of the body to conform to the circular, or arcuate configuration into which the bent skirt portion is to be returned. When each paw reaches its radial outer limit of movement, as shown in full lines in FIG. 6, its hydraulic piston rod 76 is retracted to retract the paw, such that the three paws in each head are returned to their central nested position within the straightening head, shown in broken lines in FIG. 6.

Figure 7:
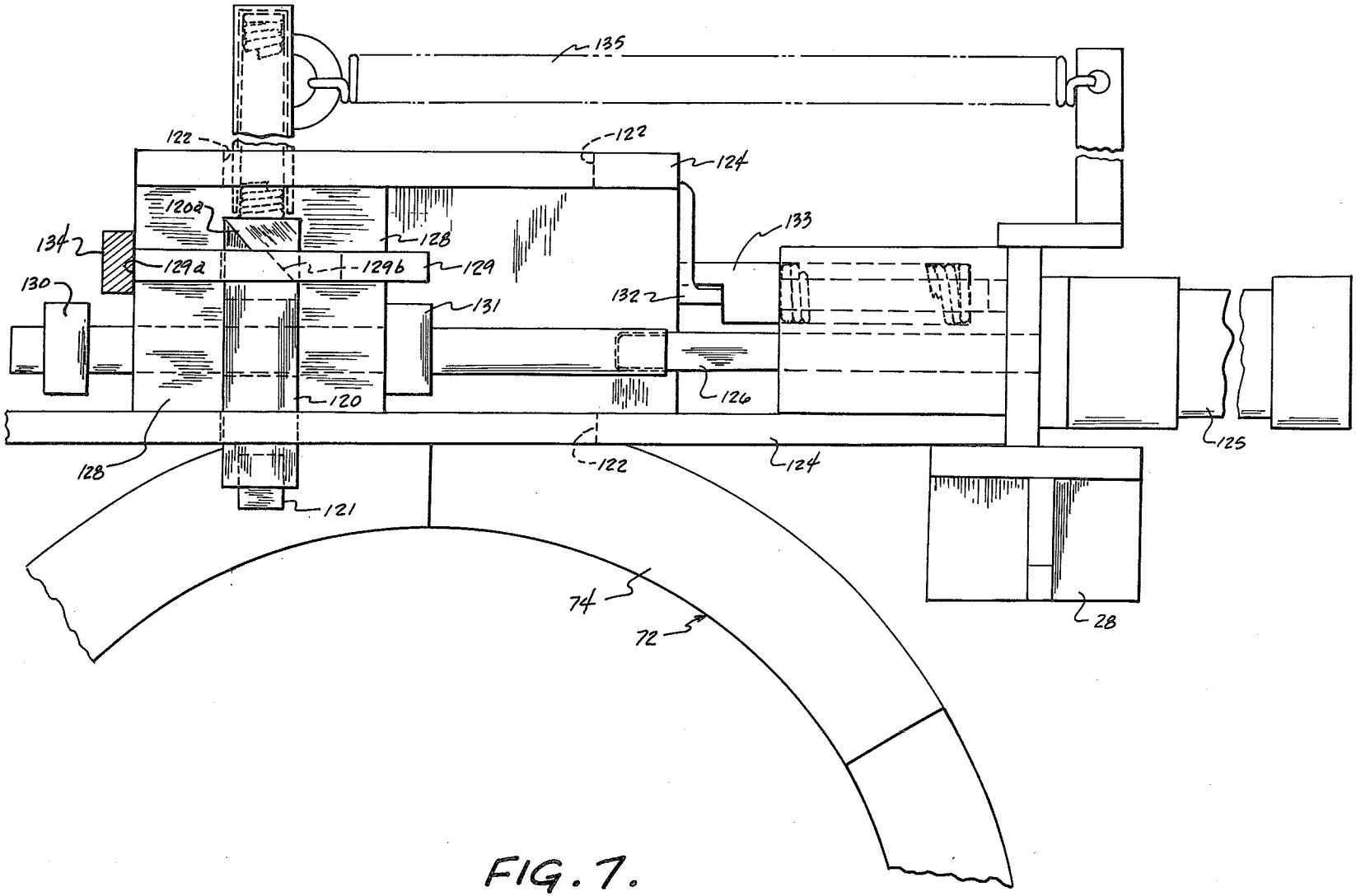
FIG. 7 is an enlarged broken away bottom plan view of the keg rotator mechanism of the skirt straightening station of the apparatus of FIG. 1 taken generally along line VII—VII and looking in the direction of the arrows.

FIG. 7 is an enlarged broken away bottom plan view of a keg rotator mechanism, with bottom housing plate removed, taken generally along line VII—VII and looking upwardly in FIG. 1. The rotator mechanism includes a spring-actuated plunger 120 having a spring-loaded urethane tip 121. Opposite ends of plunger 120 are supported for movement along horizontal slots 122 of an elongate guide member 124. As shown in FIG. 1, plunger 120 is located between the upper and lower head retaining rings 72, at one side of the straightening section 18, to engage the side of a keg held loosely within the clamping rings 72 and rotate the keg as the plunger moves horizontally in one direction along the guide slots 122. The plunger 120 is moved along the slots of guide member 124 by a double-acting, fluid-actuated piston 125, the rod 126 of which is threadably attached to a larger control rod 127 which is in turn slidably received through an opening of a rectangular sliding block 128 which carries the plunger 120. Spaced stop collars 130, 131 on support rod 127 engage and push the ends of support block 128 to reciprocate the block and finger along the guide slots 122.

Slidably carried in a lower surface slot of support block 128 is a rectangular sliding control pin 129 having an upper slotted cam surface **129*b* which cooperates with a slotted cam surface 120*a* in the opposing side wall of plunger 120. FIG. 7 shows plunger 120 in a retracted position in block 128 such that the tip 121 will not engage the side wall of a keg held in clamping rings 72. When the hydraulic piston 125 moves the block fully to the right in the guideways, as shown in FIG. 7, the end of control pin 129 strikes the end 132 of a spring-loaded plunger 133 which pushes the pin to the left in block 128, as seen in FIG. 7, to move its cam surface 129*b* along cam surface 120*a* of plunger 120, causing the tip portion 121 of the spring-loaded plunger 120 to move horizontally outward in the support block, perpendicular to the direction of the guide slots 122 and toward the retaining rings 72. In this extended position, movement of the plunger 120 to the left along slots 122, as seen in FIG. 7, will carry its tip 121 inside the circumference of the two rings 72** so that it will strike the cylindrical side wall of the keg, causing the keg to rotate as the keg end skirts are held loosely within the rings of the upper and lower straightening heads.

When block 128 and plunger 120 reach the left end of travel along guide slots 122, as seen in FIG. 7, end **129*a* of control pin 129 engages a fixed stop block 134 on the support frame to push the pin to the right and cause the cooperating cam surfaces 129*b*, 120*a* to retract the plunger back into the support block 128. An elongate spring 135 connecting the rear end of plunger 120** to the support frame counterbalances movement of the plunger in the sliding block and guide members.

Thus, when plunger 120 is moved to the right (as seen in FIG. 7) by the action of the hydraulic piston 125, it remains retracted, or cocked, in block 128 so that its tip will not contact a keg in the retaining rings. When plunger 120 moves to the left in guide slots 122, its tip is outwardly extended to pass inside the circumference of the retaining rings 72 and strike and rotate a keg held loosely therein. Depending upon the force of the rotator tip against the side of a keg, the keg will be variously rotated about its axis to move new skirt portions into position adjacent the straightening paws 70 during the skirt straightening operation.

The operation of the retaining rings 72 of each of the straightening heads 48, 50 may best be explained by reference to FIG. 4 which is a horizontal sectional view of the lower head 50 taken generally along line IV—IV of FIG. 1. As seen, each arcuate section 74 of the ring 72 has a foot portion **74*a* having two straight outer edge surfaces 74*b*. The sections are biased by springs 140 disposed between their contiguous edges so that they radially open to expand the ring when the foot portions 74*a*** are released by control elements of the retaining ring.

Radial expansion and contraction of the retaining ring is controlled by sliding wedges 141, 142 which are triangular in shape and are contained by side edges of outer fixed plates 143 and a movable V-shaped plate 144. The inside edge of each wedge engages a side edge **74*b* of two section foot portions 74*a*. The inside edges of plate 144 abut edges of wedges 141,142 and three of the foot portions 74*a* of the ring. The outer side edge of plate 144 is connected by two three link toggle mechanisms 145 to a transverse clevis 146 of the piston rod 147 of a hydraulic piston 148**.

As seen in FIG. 4, piston rod 147 is extended to move plate 144 and the sliding wedges 141, 142 to contract the spring-biased arcuate sections 74 of the rings to closely retain the skirt portions of a keg to be straightened. When piston rod 147 is retracted, the sliding wedges and plate 144 move to release spring-biased foot portions **74*a* allowing the rings 72 to expand and loosen about the skirts of the keg. During a skirt straightening operation, retaining rings 72 of the upper and lower heads are simultaneously periodically opened to loosely hold the keg when the keg rotator plunger 120 is activated to strike and rotate the keg about its cylindrical axis and bring progressive portions of the skirts into position for engagement by the skirt straightening paws 70** of the head. Safety limit switches (not shown) may be employed in the central circuitry to ensure the opening or closing of the retaining rings and the position of the rotator plunger during its operation.

The Keg Holding Station

As best seen in FIGS. 1 and 2, holding station 20 is located at a right angle to the skirt straightener section 18. Upon completion of a skirt straightening operation, the lower straightening head 50 is moved to its lowermost position to move the lower retaining ring 72 and paws 70 below the lower rim of the keg. When the lower straightening head is in its lowermost position the keg in the straightening station is positioned by its support arms 78 slightly above the lower ring 72. A pusher mechanism 150 is then activated by a hydraulic piston (not shown) to push the straightened keg out of the straightening station and onto a base support plate 151 of holding station 20. The straightened keg remains in holding station 20 until another keg with bent skirt portions is detected at the interrogator station 16. At such time, a pusher mechanism 152 of the holding station is activated simultaneously with the pusher mechanism 44 of the interrogator station so that as a bent keg in interrogator station 16 is pushed into straightening station 18, a straightened keg in holding station 20 is pushed back onto the main conveyor chains 12 for conveyance to other processing operations.

Operation of the Apparatus

Operation of the variously described components of the keg handling stations of the apparatus of the present invention may be controlled by suitable control means well known in the art. Typically, the various station components may be moved by fluid-actuated motors activated by electrical limit switches connected in conventional electrical circuitry through control and time delay relays to control means, such as an Allen-Bradley Model PLC-Mini programmable controller, which sequences the movements and operation of various components of the apparatus, as will now be described by reference to the diagrams of FIGS. 9, **10*a*, and 10*b***.

Figure 9:
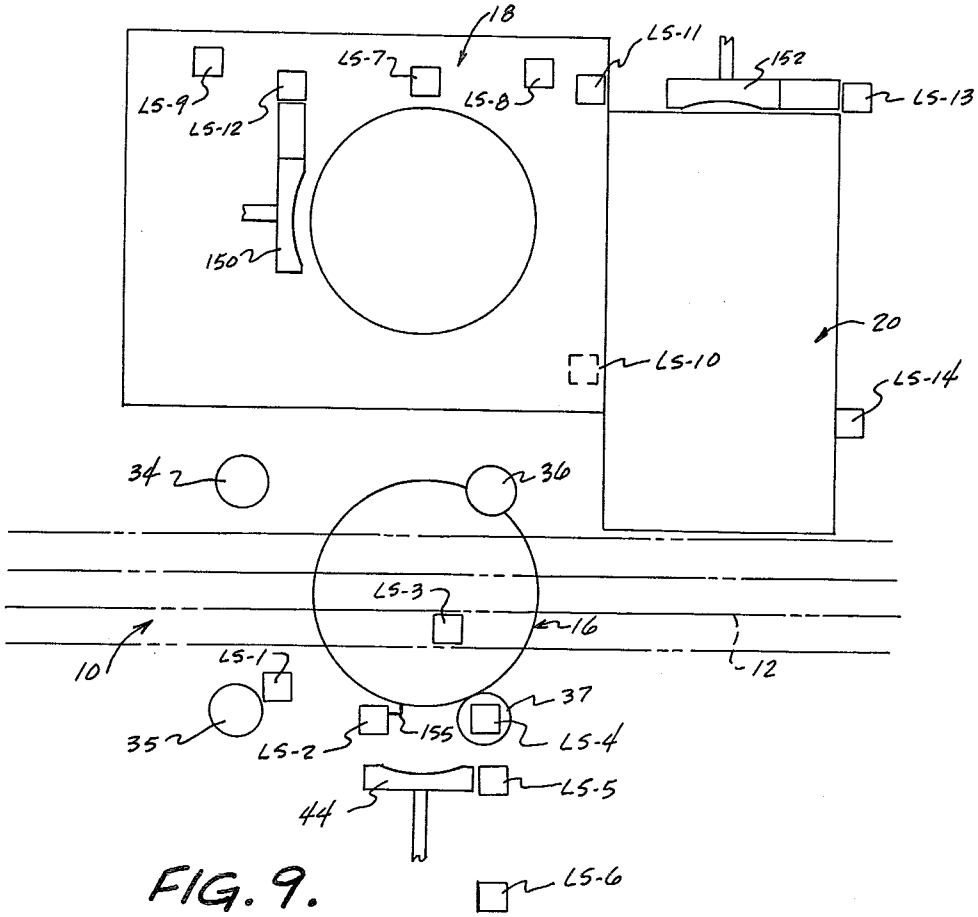
FIG. 9 is a diagrammatic plan view indicating the location of principal limit switch components of the control circuitry of the apparatus of FIG. 1.
Figure 10A:
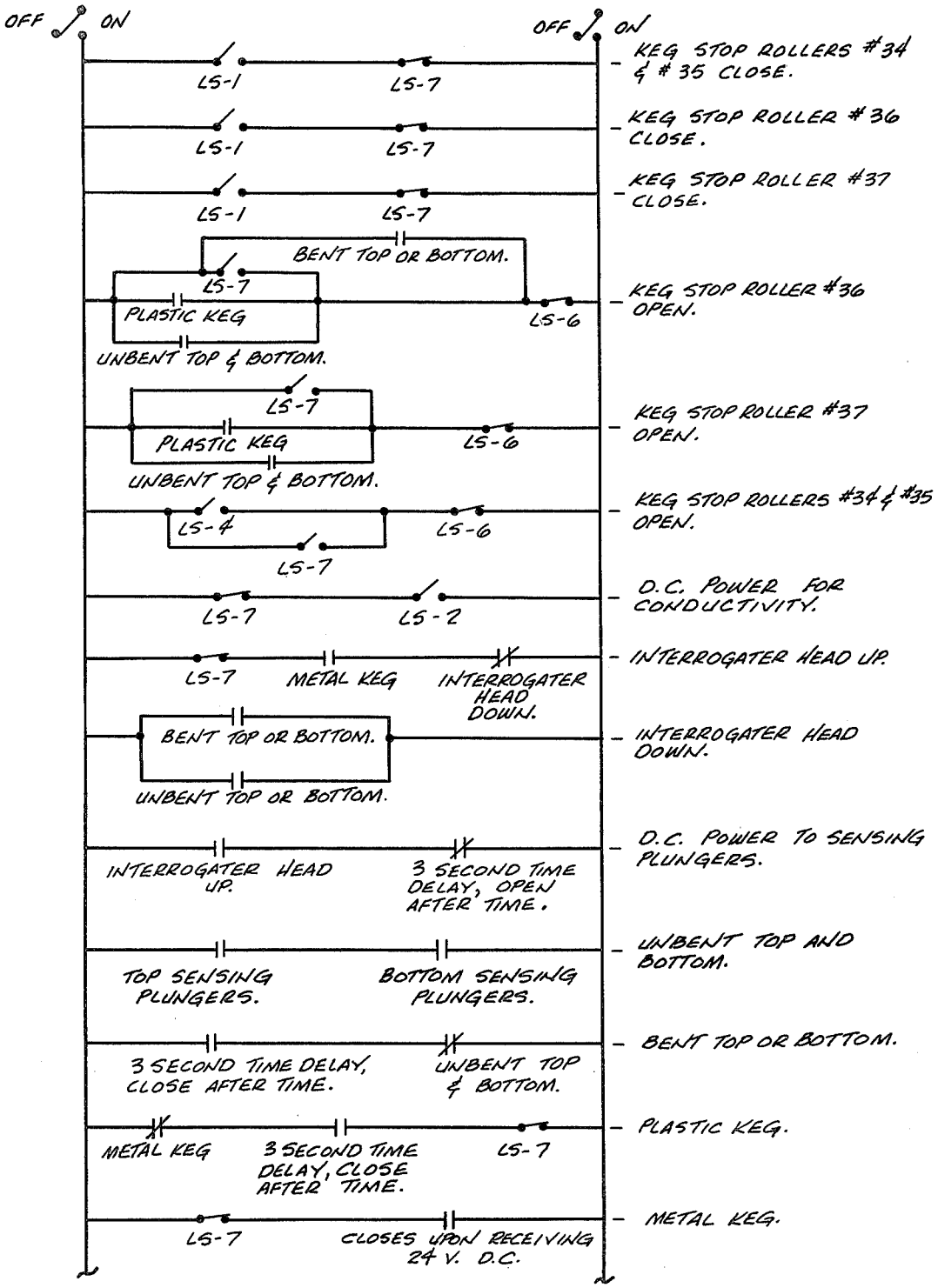
FIGS. 10*a* and 10*b* is a conceptual wiring diagram illustrating the relation of the various control switches to the functions of the apparatus controlled thereby.
Figure 10B:
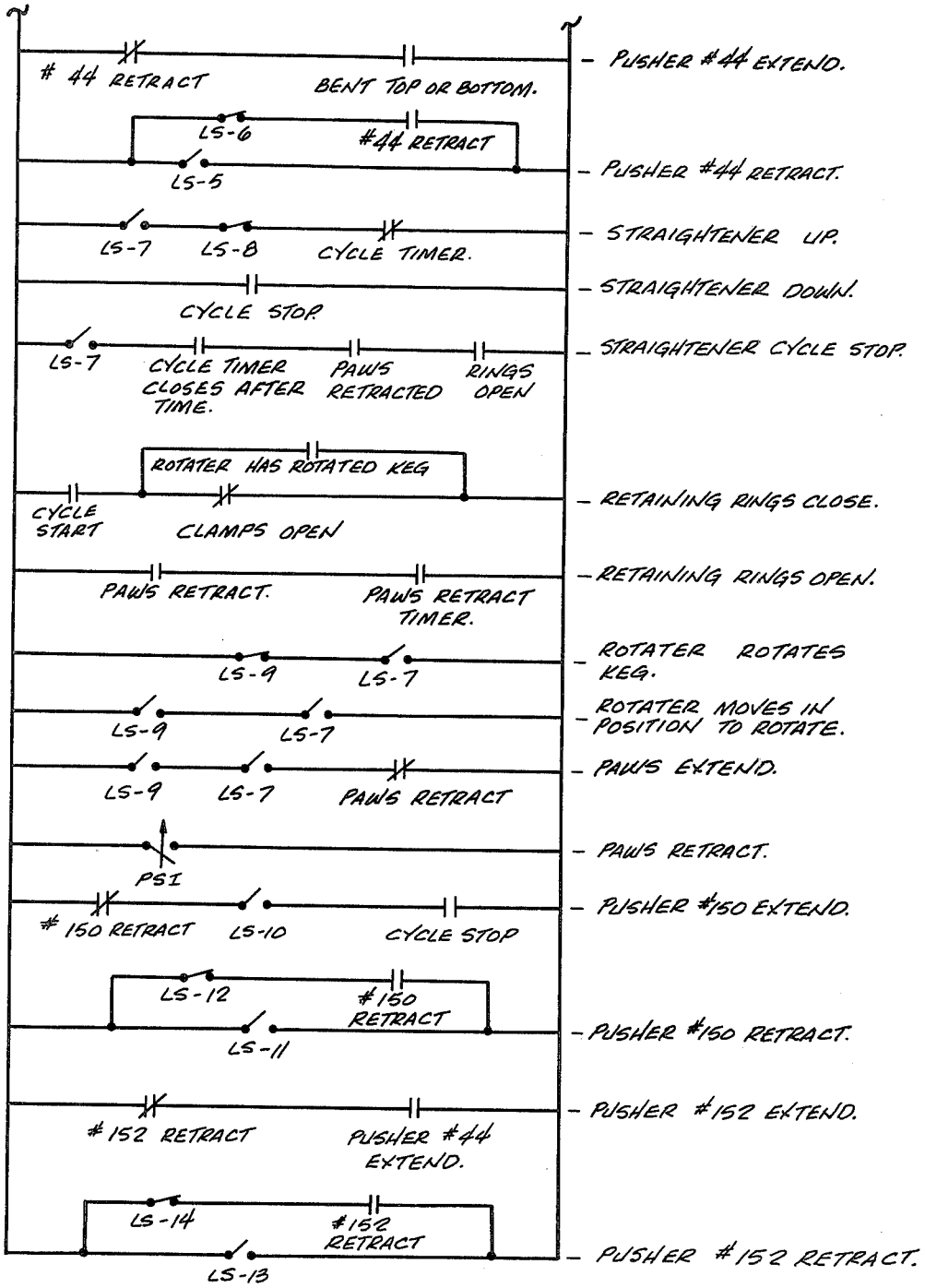

As seen in FIGS. 9 and 10, as a keg on main conveyor 10 enters the interrogator station 16, the side of the keg engages and trips a first limit switch LS1 which signals through the control circuitry to activate the fluid pistons 38 of keg stop rollers 34 through 37 to pivot the rollers into the main conveyor path 10. Rollers 34, 35 hold the line of kegs on the conveyor chains from entering the interrogator station and rollers 36, 37 hold a single keg in station 16 for interrogation. Since both plastic and metal skirted kegs may be processed on the main conveyor 10 in refilling operations, a keg in station 16 is first interrogated to determine its construction, i.e., metal or plastic skirts. When a keg is positioned in station 16, it trips a second limit switch LS2 which supplies 24 volt DC power to a pair of spaced electrical conductivity probes 155 which engage the skirts. Probes 155 are electrically connected to the DC supply through an electrical timer which supplies current to the probes for 3 seconds. If electricity is not conducted through the wall of the keg between the contact probes, indicating a non-metallic or plastic skirt construction, the keg stop rollers 36, 37 are pivoted out of conveyor path 10 to allow the keg in station 16 to continue along the main conveyor without being subjected to bent skirt interrogation or a metal skirt straightening operation.

If current is conducted by the keg wall between the spaced conductivity probes, indicating the presence of a keg with metal skirts, hydraulic piston 32 of lower sensing head 24 of the interrogator is activated to raise the head and keg above the conveyor chains 12 and bring the upper and lower metal rims of the keg skirts into engagement with plungers 26 of the upper and lower sensing heads. With the keg so positioned, 24 volt direct current is passed through a timing circuit for a period of three seconds to the series-connected proximity switches 42 (FIG. 3) of the plungers of each head. If all plungers are displaced by contact with the rims, current is passed through all switches of the upper and lower head electrical circuits, indicating the presence of a keg without bent metal skirt portions. Hydraulic piston 32 is activated to lower the head 24 and place the keg back on the moving conveyor chains of the main conveyor. When the head reaches lowermost position, it engages limit switch LS3 to activate pistons of stop rollers 36, 37 and move them out of the main conveyor path. The good keg is conveyed along the main conveyor for further processing.

As an unbent metal or a plastic skirted keg passes along main conveyor 10 from interrogator station 16, it strikes a limit switch LS4 which through its circuitry activates and opens the keg line stop rollers 34, 35. Another keg in line upstream on the conveyor moves into the interrogator station to trip the limit switch LS1, close the keg stop rollers 34–37, and start another sequence of keg interrogation.

If current is not received through the proximity switch circuitry of either the top or the bottom head plunger arrays in the 3 second time interval, this indicates a corresponding bent skirt portion in the top or bottom skirt of the keg. Hydraulic piston 32 is activated to move the lower sensing head 24 downwardly and place the ket with bent metal skirt portions back on the main conveyor chains 12. Absence of a signal from either the upper or lower sensing head circuits with displacement of LS3 activates keg stop roller 36 to move it out of the path of the keg into station 18 and pusher mechanism 44 is activated to push the bent keg at a right angle off the conveyor 10 into the skirt straightening station. Limit switches LS5 and LS6 located at each end of the path of movement of pusher mechanism 44 are safety switches to ensure that the pusher mechanism fully extends and fully retracts before keg stop rollers 34–37 are moved to allow line kegs to pass through the interrogator station.

As a bent keg is pushed into straightening station 18, the side wall of the keg strikes a limit switch LS-7 to indicate proper position of the keg on keg support arms 78 with the upper and lower skirts in position for encirclement by retaining rings 72 of the upper and lower straightening heads 48, 50. Displacement of limit switch LS-7 indicating the presence of a bent keg in the straightener station 18 also deactivates the interrogator station circuitry and the keg blocking operation of the keg stop rollers 34–37, allowing continuous passage of kegs along the main conveyor 10 through the interrogator station at all times when a keg is in the straightening station.

When limit switch LS-7 is engaged, hydraulic piston 68 of the lower straightening head 50 is activated to raise the head. Initial upward movement of head 50 brings the lower retaining ring 72 up around the lower skirt of the keg on the support arms 78. Thereafter, continued upward movement of head 50 raises the keg support arms 78 with the lower ring 72 and paws 70 to introduce the upper end of the keg into the upper straightening head 48, with the upper retaining ring 72 surrounding the outer circumference of the upper skirt. The three straightening paws 70 of both the upper and lower heads are thus located centrally in a nested position within the upper and lower skirts of the keg. When the lower head 50 rises to its upper limit, it engages a limit switch LS-8 which activates the retaining ring pistons 148 (FIG. 4) to close both the upper and lower rings 72 more closely about the upper and lower skirts of the keg. The closing of rings 72 opens a pair of adjacent limit switches LS-9 which horizontally move and then extend the rotator plunger 120 to a position ready for striking the keg. Switches LS-9 also activate the pistons of the top and bottom sets of straightening paws 70.

The hydraulic pistons 76 of paws 70 in upper and lower heads 48, 50 are simultaneously activated to move the paws, as previously described, radially outward to pass in close proximity to the respective upper and lower curved end walls of the keg, engaging any inwardly bent skirt portions in their paths to pry and push the same radially outward into a circular configuration. When the paws reach their outer radial limit, a hydraulic pressure switch PSI (FIG. 10) in the paw hydraulic control system is activated to reverse hydraulic fluid flow to the double-acting pistons 76 and retract the paws 70 back into their central nested position. After retraction, a time-delayed signal activates the hydraulic pistons 148 of each retaining ring 72 to open the rings and more loosely surround the end skirts of the keg. When the rings open, closing switches LS-9, the extended keg rotator plunger 120 moves quickly in its horizontal guide slots 122 to strike and rotate the keg loosely held in the two retaining rings 72. After plunger movement and rotation of the keg, the rings close and the paws are again activated to perform a straightening operation.

The number of advances of the keg by the rotator mechanism followed by paw activation is controlled by adjustable timing means in a timing circuit set to allow sufficient repeat of the straightening cycles until all portions of the circumference of the keg skirt have been engaged by the paws. Generally, four rotational advances of the keg are sufficient to ensure complete contact of all circumferential portions of the keg skirts by paws 70. When the straightening cycles are complete, the paws of the upper and lower heads retract and the retaining rings open. Lower head 50 moves downward to its lowermost position to locate the paws and retaining rings of the upper and lower heads respectively above and below the ends of the keg, with the keg supported on the support arms 78 just above the upper surface of the lower ring 72.

When lower head 50 reaches its lowermost limit, it trips a limit switch LS-10 which activates pusher mechanism 150 to push the keg from the straightening station 18 into the keg holding station 20. When pusher 150 is fully extended it contacts a limit switch LS-11 to retract the pusher. When pusher 150 is fully retracted, it contacts a limit switch LS-12 to reenergize the keg stop rollers 34–37 and the interrogator station 16, once again enabling individual kegs carried on conveyor 10 to be interrogated for bent skirt portions until a bent metal skirt is again detected.

A straightened keg in holding station 20 remains there until another keg at interrogator station 16 has been detected to have a bent metal skirt portion. At the time that the bent keg in interrogator station 16 is pushed by pusher mechanism 44 into straightening station 18, pusher mechanism 152 at holding station 20 simultaneously pushes the previously straightened keg back onto the chains 12 of the main conveyor 10. By introducing a straightened keg from holding station 20 onto the main conveyor 10 simultaneously with transfer of a bent keg therefrom into straightening station 18, a space is insured on the main conveyor for receiving the straightened keg from the holding station. Safety limit switches LS-13 and 14 are located at the ends of travel of pusher mechanism 152.

Because of the time required to perform a skirt straightening operation, e.g., 30 seconds, the apparatus of the present invention is programmed not to interrogate kegs at interrogator station 16 unless keg skirt straightening station 18 is open to receive a keg for straightening. Although the interrogator station may be programmed to interrogate up to 700 kegs per hour, the skirt straightening station 18 generally is programmed and can be operated to straighten the skirts of approximately 100 kegs per hour. Because kegs are typically handled on the main conveyor for washing and filling operations at a rate of 450 per hour, it is possible that a keg having a bent skirt portion may not be interrogated and straightened each time it is returned for refilling. However, since kegs are normally returned to a brewery a number of times annually for refilling, it is contemplated that the skirt straightening apparatus of the invention will provide effective automated straightening of most bent beer kegs in the marketplace which are returned to the brewery, without decreasing or sacrificing the higher speeds of conventional brewery kegs refilling operations.

The apparatus of the present invention may be modified, if desired, by providing an extended keg conveying path between the interrogator station and the straightening station to allow for an accumulation of detected bent kegs for delivery to the straightening station.

That which is claimed is:

1. Apparatus for detecting and straightening bent skirt portions of generally cylindrical containers having depending circular metal end skirts normally extending generally parallel to the cylindrical axis of the containers comprising:

(a) sensing means positioned in a path of travel of a plurality of containers for detecting displacement of one or more portions of the end skirts of selected of the containers from the normal circular configuration of the skirts, (b) means responsive to said sensing means for directing a container having a detected displaced skirt portion to a skirt-straightening station, (c) means at said skirt-straightening station for holding the container and for applying a force to displaced portions of the container skirts to move the same back into circular configuration, and (d) means for directing the straightened container back into said path of travel for movement with said plurality of containers.

2. Apparatus as defined in claim 1 wherein said skirt straightening station holding means includes means for retaining end skirt portions of the container during activation of said force applying means, and means for incrementally rotating the container about its central cylindrical axis to bring successive circumferential portions of the skirt into position for successive engagements by said force applying means.

3. Apparatus as defined in claim 2 wherein said retaining means comprises adjustable ring means for closely surrounding the outer peripheries of the end skirts of the container during activation of said force applying means.

4. Apparatus as defined in claim 1 wherein the skirts of the containers terminate in a rim, and wherein said means for applying a force to displaced portions of the skirts to move the portions back into circular configuration comprise means movable between the ends of the container main body and the skirt rims at the displaced portions of the skirt to engage and pry the same away from the ends of the container and push the bent skirt portions outwardly of the central axis of the container to reposition the rims and skirts in a circular configuration.

5. Apparatus as defined in claim 4 wherein said means for engaging the rims of the skirts include at least three movable paw means spaced at equal distances around the cylindrical axis of the container for movement from a retracted position adjacent the central cylindrical axis of the container radially outward to reposition the bent skirt portions of the container.

6. Apparatus as defined in claim 5 wherein said force applying means includes fluid operated means for moving said movable paw means.

7. Apparatus as defined in claim 1 wherein said means for applying a force to displaced portions of the container skirts to move the skirts back into circular configuration includes means for simultaneously applying a force to the skirts at both ends of the container to move the displaced portions of the skirts.

8. Apparatus as defined in claim 1 wherein said sensing means comprises a circular array of plunger means for engaging rim portions of the skirt of the container to be displaced thereby, and means responsive to the absence of displacement of one or more of the plunger means to direct the container to said skirt straightening station.

9. Apparatus as defined in claim 8 wherein said circular array of plunger means comprises two circular arrays of said means for simultaneously engaging spaced rim portions of both skirts of the container to detect the displacement of the circular skirts.

10. Apparatus as defined in claim 1 wherein said means for holding the container at said skirt straightening station comprise retaining means for periodically closely surrounding the container, means for activating said force applying means to move displaced portions of the skirts back into circular configuration when said retaining means are closely surrounding the container, and means for incrementally rotating the container about its central cylindrical axis to bring subsequent portions of the container skirts into position for contact by said force applying means.

11. Apparatus as defined in claim 10 wherein said force applying means comprise a plurality of arcuately spaced paw means centrally positioned with respect to said retaining means for radial outward curved path movement to engage and force arcuately spaced, inwardly bent skirt portions of the container outwardly into circular configuration and for radial inward movement to a nested position to permit incremental rotation of the container about its central cylindrical axis.

12. Apparatus as defined in claim 10 wherein said retaining means comprise spaced ring members for alternately closely surrounding and more loosely surrounding the two end skirts of the container, and said means for incrementally rotating the container about its central cylindrical axis comprises rotator means positioned between said spaced ring members to the side of a container held therein and movable in a generally straight line direction perpendicular to the central cylindrical axis of the container to strike a side wall portion of the same and rotate the container about its central cylindrical axis.

13. Apparatus as defined in claim 1 wherein said sensing means includes an interrogator station positioned in said path of travel of said plurality of containers and having means for detecting skirt portions of metallic construction.

14. Apparatus as defined in claim 13 wherein said skirt portion detecting means includes a pair of spaced electrical conductivity probes for engaging the keg end skirts at spaced locations, and electrical circuit means for directing electrical current to the probes whereby conduction of the current through the container between the probes establishes the metallic nature of the skirt portions.

15. Apparatus as defined in claim 1 wherein said sensing means comprises upper and lower sensing heads, each having a circular array of plunger means for engaging the rims of the skirts of a container at spaced locations along their extent, a lower of said heads being movable upwardly to engage and lift a container and bring said arrays of plunger means into engagement with respective upper and lower skirt rims of the container, means mounting each of said plunger means for displacement by contact with a rim portion of the container, and means responsive to absence of displacement of one or more of the plunger means for directing the container to said skirt-straightening station.

16. A method of detecting and straightening bent skirt portions of generally cylindrical containers having depending circular metal end skirts normally extending generally parallel to the cylindrical axis of the containers comprising the steps of (a) interrogating containers moving in a primary path of travel to detect the displacement of any portions of the end skirts of the containers from the normal circular configuration of the skirt;

(b) directing containers having detected displaced skirt portions to a skirt-straightening station;

(c) straightening the bent skirt portions of containers directed to said skirt-straightening station; and (d) redirecting straightened containers from said skirt-straightening station into said primary path of travel for subsequent handling.

17. A method as defined in claim 16 wherein containers moving in the primary path of travel are interrogated by sensing the position of the rims of the end skirts at spaced locations along their extent to determine the displacement of any portions of the rims from the normal circular configuration of the skirt.

18. A method as defined in claim 17 wherein skirt portions of a container are first sensed to determine that they are of metal construction before the rims of the skirts are sensed to determine their displacement.

19. A method as defined in claim 16 wherein bent skirt portions of containers directed to the skirt straightening station are straightened by retaining the ends of the container while directing forces radially outward of the central cylindrical axis of the container against inwardly bent skirt portions to push the same outwardly into normal circular configuration.

20. A method as defined in claim 19 wherein said forces are directed radially outward against inwardly bent skirt portions of the container a plurality of times at spaced locations about the circumference of the skirts, and wherein the container is rotated about its central cylindrical axis between outward applications of said forces to bring all portions of the circumference of the skirts into position for application of said forces.

* * * * *